US006470632B1

(12) United States Patent
Smith

(10) Patent No.: US 6,470,632 B1
(45) Date of Patent: Oct. 29, 2002

(54) MODIFIED A-FRAME BUILDING AND TRUSS FOR SAME

(76) Inventor: Arthur E. Smith, 159 Lakeshore Dr., Duluth, GA (US) 30096

( * ) Notice: Subject to any disclaimer, the term of this patent is extended or adjusted under 35 U.S.C. 154(b) by 95 days.

(21) Appl. No.: 09/705,544

(22) Filed: Nov. 4, 2000

(51) Int. Cl.[7] ..... E04B 7/02; E04C 3/42

(52) U.S. Cl. ..... 52/92.2; 52/92.3; 52/642; 52/643

(58) Field of Search ..... 52/92.1, 92.2, 52/92.3, 90.1, 639, 640, 641, 642, 643

(56) References Cited

U.S. PATENT DOCUMENTS

| | | | | | |
|---|---|---|---|---|---|
| 553,903 | A | * | 2/1896 | Duvinage | 52/639 |
| 872,658 | A | * | 12/1907 | Lee | 52/92.3 |
| 1,003,435 | A | * | 9/1911 | Covert | 52/641 |
| 1,070,434 | A | | 8/1913 | Farquhar | |
| 1,170,188 | A | * | 2/1916 | Rasmussen et al. | 52/641 |
| 1,369,837 | A | * | 3/1921 | Price | 52/639 |
| 1,504,318 | A | * | 8/1924 | Berglund | 52/643 |
| 1,951,634 | A | * | 3/1934 | Steck | 52/643 |
| 2,280,832 | A | | 4/1942 | Ketcham | |
| 2,332,059 | A | * | 10/1943 | Cheshier | 52/643 |
| 2,604,060 | A | * | 7/1952 | Hansen | 52/643 |
| 2,653,553 | A | * | 9/1953 | Jacobs | 52/641 |
| 3,283,693 | A | | 11/1966 | Howell | |
| 3,464,167 | A | | 9/1969 | Mason | |
| 3,861,095 | A | | 1/1975 | Eoxworthy | |
| 4,024,682 | A | | 5/1977 | Jamison | |
| 4,437,273 | A | | 3/1984 | Helfman | |
| 4,503,651 | A | * | 3/1985 | Pugh | 52/639 |
| 4,538,393 | A | * | 9/1985 | Mitchell | 52/641 |
| 5,524,397 | A | * | 6/1996 | Byers et al. | 52/92.2 |

FOREIGN PATENT DOCUMENTS

| | | | | |
|---|---|---|---|---|
| AU | 470653 | * | 2/1973 | 52/640 |
| WO | WO-92/02696 | * | 2/1992 | 52/640 |

* cited by examiner

*Primary Examiner*—Michael Safavi
(74) *Attorney, Agent, or Firm*—Baker, Donelson, Bearman & Caldwell

(57) ABSTRACT

A modified A-frame shell building 10 with a cementitious foundation having a pair of upstanding opposing stub walls 16, 18 that engage and support a plurality of trusses 50 disposed in spaced-apart relation for supporting a roof 58. Each truss comprises a pair of rafter beams with 45° beveled corners at opposing distal ends. The rafter beams 52 rigidly join together at a 90° angle at abutted corners 75 at distal ends 72, which defines a notch 106 that receives a ridge beam 62 extending across the trusses 50. The trusses include a collar beam 56 oppositely beveled at opposing distal ends 83, 85 and connected to the rafter beams 52 intermediate the distal ends 70, 72 of the rafter beams. Base plates 84 attached to the distal end 70 of the rafters 52 receive fasteners to engage the trusses 50 to the stub walls 16, 18. A roof 58 is defined by a deck 92 of tongue and groove boards covered by a insulative panel 93 and roofing materials such as shingles 94.

11 Claims, 5 Drawing Sheets

MODIFIED A-FRAME BUILDING AND TRUSS FOR SAME

The present invention relates to modular buildings. More particularly, the present invention relates to truss and rafter assemblies for constructing modified A-frame shell buildings at construction sites which buildings are readily finished.

BACKGROUND OF THE INVENTION

Recently, there has developed increasing interest in reasonable-cost housing that is easily constructed, yet provide solid and stable structure. One aspect of such increasing interest arises from the changing demographics with couples finding the need for large housing decreasing as children grow and move to separate housing. In other aspects, increased leisure time is providing opportunities for persons to locate and spend time for recreation in other areas of the country, such as mountain or shore areas, away from the vicinity in which they reside. Also, there is a trend towards moving away from large communities to small ones, for a change of urban pace. Each of these, and other factors, provide interest in available reasonable-cost housing for construction of residences.

Heretofore, A-frame designs have been used to construct buildings for residences and business purposes, particularly in mountainous areas. A-frames have roof lines in the shape of an A, and hence, the name. The roof pitches sharply an angle to an apex. The shape provides for an intermediate floor or loft typically as a second level, with a larger area below for living space, kitchen, and the like. This design accordingly provides a small-footprint for a vacation or recreational second home. The sharply pitched roof lines however, create limited floor space for comfortable walking, as the sides pitch limit the headroom in the side areas of the floor space. These side areas are used for bookcases, furniture, and other items which have reduced risk of a person hitting the ceiling.

In addition, conventional construction has increased the use of pre-fabricated structural components for building homes and business places. These include pre-built staircases as well as truss structures. Truss structures generally have roof rafters and cross-members extending between the rafters, and support members extending between the rafter and the cross-member. For building construction, such components are manufactured off-site, and delivered to construction sites by truck for erection onto a building having stud-frame vertical walls. While the use of such components has provided cost savings, for an individual constructing or providing general contractor supervision of a reasonable-cost vacation home, these components are not entirely satisfactory. The labor to manufacture and deliver the assembled components may increase the costs significantly such that these are not practical or economical for second home or self-constructed buildings. The weight and size of such components also presents difficulties in construction of low-cost buildings.

Accordingly, there is a need in the art for an improved truss assemblies with rafter and collar beam members for constructing modified A-frame buildings. It is to such that the present invention is directed.

SUMMARY OF THE PRESENT INVENTION

The present invention meets the need in the art by providing a truss for use with a plurality of such trusses to construct a modified A-frame building, in which the truss comprises a pair of elongated rafter beams having side faces and bottom faces, each having a first and a second 45° beveled corner at opposing first and second distal ends, and the pair of rafter beams rigidly joined together at a 90° angle at the respective first distal ends with the first beveled corners of the pair of rafter beams abutted together. The aligned first distal ends of the pair of rafter beams define a 90° trough for receiving an elongated roof ridge member to extend at least between adjacent ones of the trusses. An elongated collar beam oppositely beveled at opposing distal ends connects at distal ends with connector plates to bottom faces of the pair of rafter beams intermediate the distal ends thereof. A pair of angled end connector plates fasten on one surface to the side faces of the pair of rafter beams at the opposing second beveled corner and provide a surface for fastening to an upper edge of the stub wall.

In another aspect, the present invention provides a modified A-frame shell building in which a plurality the trusses described above are disposed in spaced-apart relation and attached to opposing stub walls extending from a base of a cementitious foundation. An elongated roof ridge member seats in the troughs and extends between the spaced-apart trusses. A roof comprising tongue and groove boards, an intermediate insulative layer, and roofing shingles attach to the upper surfaces of the roof rafter beams.

Objects, features, and advantages of the present invention will become apparent from a reading of the following specifications, in conjunction with the drawings and the appended claims.

DETAILED DESCRIPTION OF THE PREFERRED EMBODIMENT

Figure 1:
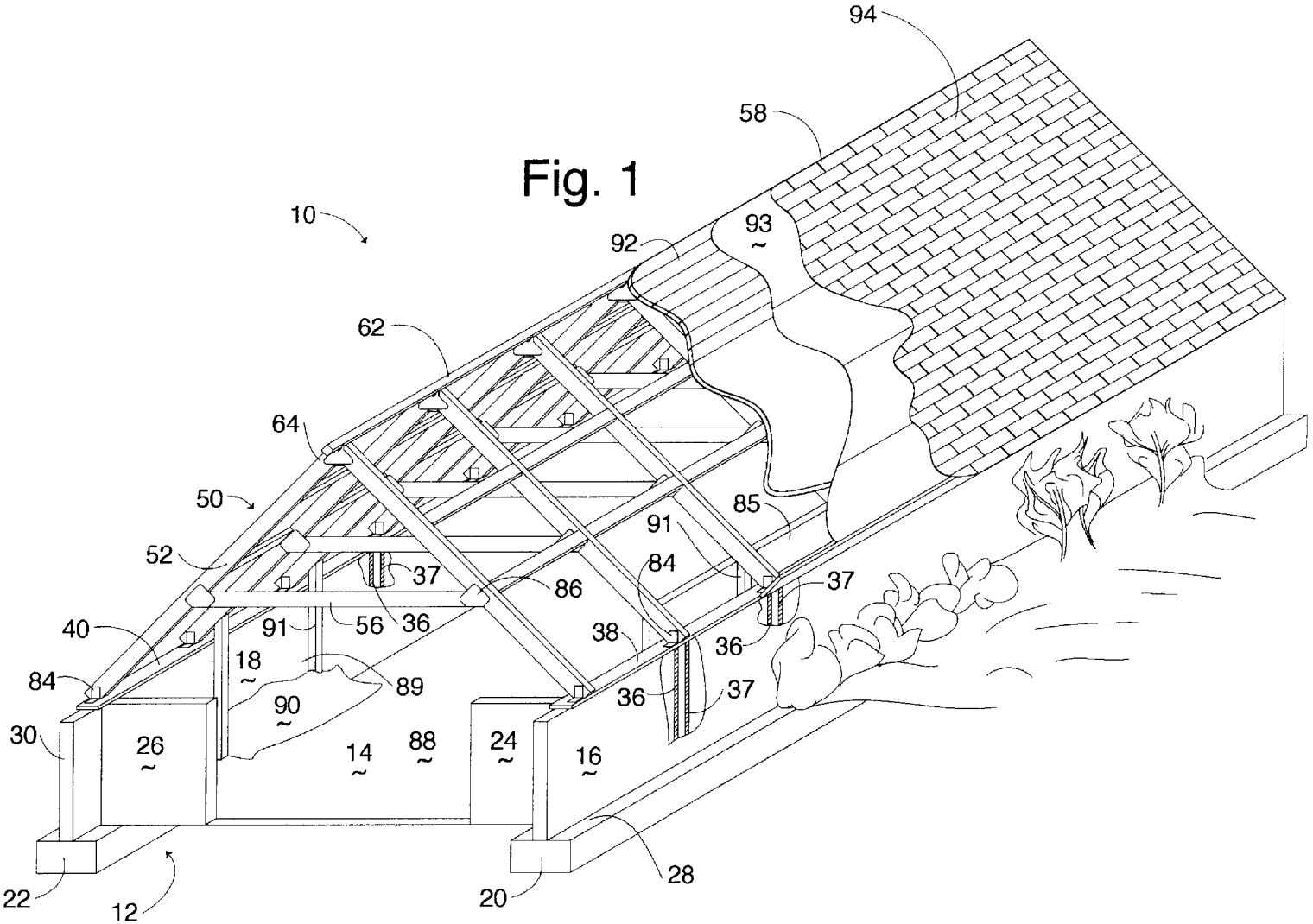
FIG. 1 is a perspective view of a modified A-frame building according to the present invention.

Referring now in more detail to the drawings, in which like numerals indicate like parts throughout the several views, FIG. 1 illustrates a perspective view of modified A-frame building 10 incorporating features of the present invention. The A-frame building 10 includes a foundation 12 with a wide area floor 14 that defines a base from which extends a pair of upstanding, opposing stub foundation walls 16, 18. The stub walls 16, 18 extend upwardly from footers 20, 22. A pair of opposing end walls 24, 26 extend from the foundation floor 14 in opposing relation. In the illustrated embodiment, the end walls 24, 26 are recessed inwardly from respective ends 28, 30 of the stub wall 16, 18. A plurality of pairs of threaded pins 36, 37 are disposed in spaced-apart relation in the stub walls 16, 18 during formation of the foundation 12. Although not illustrated, the foundation 12 includes other conventional structural components, such as wire grids, for rigidity and support of the foundation which is preferably poured with concrete on an excavated construction site.

The pins 36 extend upwardly from the upper edge of the stub walls 16, 18. The upper edge of the stub walls 16, 18 receive a top plate 38, 40. The top plate 38, 40 are preferably elongate wooden boards having bores defined therein in alinement with the threaded pins 36. The pins extend through the top plates, and receive fasteners as discussed below.

The A-frame building 10 includes a plurality of truss assemblies 50. Each truss assembly 50 is a framework of two rafter beams 52 and a collar beam 56 that connect together to form a rigid framework or supporting structure for a roof 58. As discussed below, the three structural beams in the truss 50 are arranged at 45° (the two rafter beams 52 to the collar beam 56) and at 90° (one rafter beam 52 to an opposing rafter beam). Adjacent trusses 50 are spaced apart and interconnected by struts or rack beams 60 which also function to support panels that define the roof 58. A ridge beam or cap 62 attaches to an upper apex 64 of the trusses 50 in the A-frame building 10.

Figure 2:
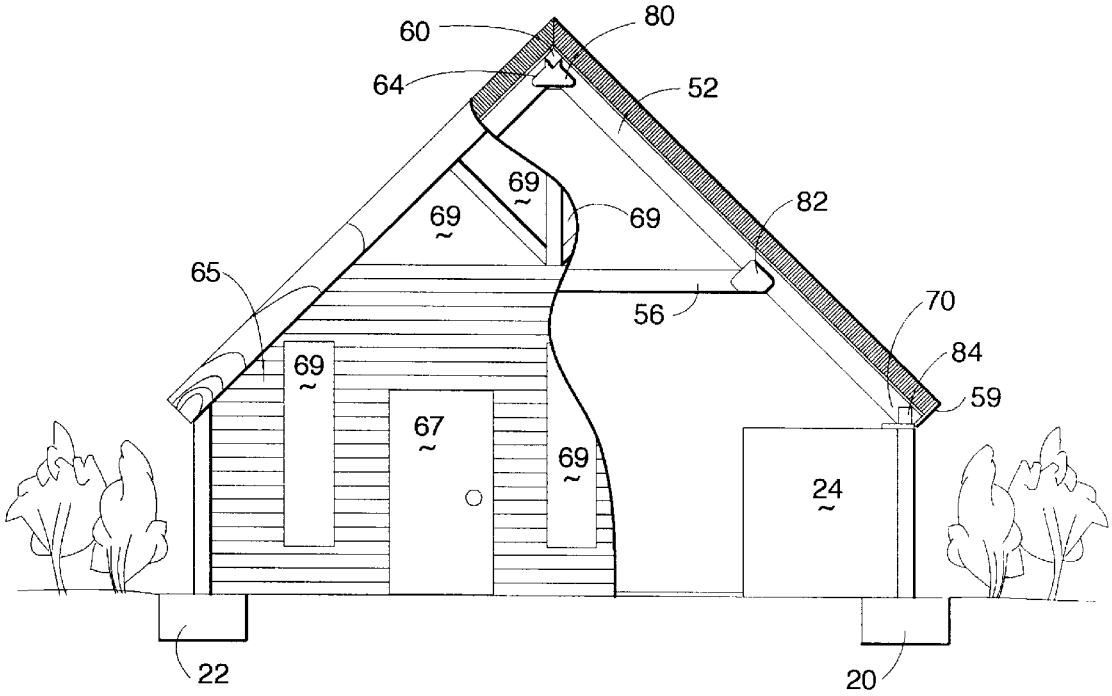
FIG. 2 is an elevational view illustrating an entrance side of the modified A-frame building illustrated in FIG. 1.

FIG. 2 is an elevational view illustrating an entrance side 65 of the modified A-frame building 10 illustrated in FIG. 1. The entrance side 65 of the building 10 includes a door 67 and windows 69 mounted in a conventional stud frame wall. The exterior is selectively finished with conventional materials and treatments, such as panels, siding, brick, or the like. The exterior sides of the stud walls 16, 18 may be bermed with earthen materials, rocks 71, or the like. The opposing end of the building 10 can likewise be finished with a wall and exterior treatments. In the illustrated embodiment, the windows provide a "chalet" appearance, with an upper gable zone generally 71 above the collar beam 56 divided into triangular glass sections separated by wood trim. Other ornamental appearances are readily installed as desired by the persons for whom the building 10 is to be constructed.

Figure 3:
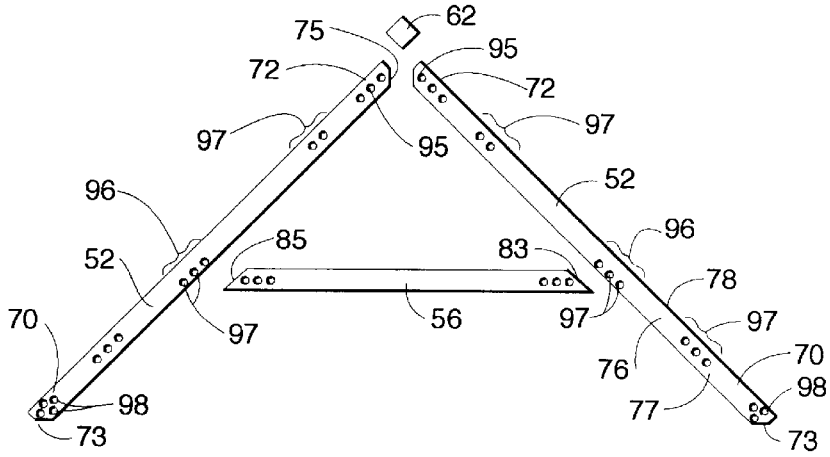
FIG. 3 is an exploded view of a truss used in a constructing the modified A-frame building illustrated in FIG. 1.

With reference to both FIGS. 2 and 3, the rafter beam 52 is described below. FIG. 3 is an exploded view of the truss 50 used in a constructing the modified A-frame building 10 illustrated in FIG. 1. The rafter beams 52 are of a predetermined length, and are elongate rigid beam like members, such as wood or other appropriate material. In a preferred embodiment, the rafter beams 52 are architectural grade glue laminated beams. Opposing distal ends 70, 72 each define a beveled corner 73, 75 on the same longitudinal side of the beam. Preferably, the angle of the bevel is 45°. The rafter beam 52 includes opposing side faces 76, a bottom face 77, and an upper face 78. The rafter beams 52, 54 preferably include sets of pre-drilled holes generally 98 in a portion of the distal end 70, holes generally 95 in a portion of the distal end 72, intermediate collar beam holes generally 96, and rack beam holes 97. It is to be appreciated that two of the holes 96 also are used to secure one of the rack beams 60, and are also labeled 97. The holes receive fasteners for assembling the truss 50, as discussed below.

A steel top plate 80 (discussed below) receives fasteners that pass through the holes 95 for securing the respective distal ends 73 of a pair of the rafter beams 52 together at an apex 64 to construct the truss 50. The pre-cut angled corners 75 cooperatively define a 90° angle for the truss 50 at the apex 64.

The joist or collar beam 56 connects to the pair of rafter beams 52 with fasteners and a steel mid plate 82 (discussed below). The fasteners pass through the holes 96 to secure the collar beam 56 to the rafter beams 52. The collar beam 56 defines oppositely beveled distal ends 83, 85. The angle of the bevel is preferably 45° relative to a longitudinal axis of the collar beam 56. The ends 83, 85 abut against the respective bottom faces 77 of the pair of rafter beams 52 intermediate the distal ends 70, 72. The collar beam 56 is of a similar material to the rafter beams 52 and preferably comprises a glue-laminate composite.

A steel base plate 84 connects to an end portion of the rafter beams 52 on the opposing faces 76 near the respective distal ends 70 opposing the apex 64. The base plates 84 define a plurality of holes (as discussed below) through which the threaded pins 36. Nuts are received on the pins 36 to secure the truss 50 to the stub walls 16, 18. Fasteners also extend through the base plates 84 and the aligned holes 98 in the rafter beam 52 to secure the rafter to the stub walls of the foundation.

With continuing reference to FIG. 1, the spaced-apart rack beams 60 attach with the steel rack beam brackets 86 to opposing faces 76 of adjacent rafter beams 52. Fasteners extend through the rack brackets 86 and the aligned holes 97 in the rafter beam 52. The rack beams 60 interlock the adjacent truss assemblies 50 for defining a rigid interconnected framework for the roof 58 of the A-frame building 10.

The modified A-frame building 10 of the present invention is particularly suited for defining a living space generally 88 from storage spaces generally 89 along the sides of the building. This is accomplished by constructing and installing nonload-bearing interior walls 90 with interior studs 91 used in conventional stud wall construction. The walls 90 connect to the rafter beams 52. The walls 90 are spaced away from the stub walls 16, 18. The walls 90 are generally close to the respective stub walls 16, 18 per specific room application to leave as narrow a side space 89 as possible. For example, in a bedroom portion, the space 89 may be three feet wide for a closet, while in a living room portion, the depth of the space 89 may be only eighteen inches for a built-in cabinet to house a television, stereo, or book shelves. In the illustrated embodiment, such spacing of the wall 90 allows the main space 88 to have a distance of twenty to twenty-two feet between the opposing walls 90, with a floor-to-peak ceiling height of about sixteen feet. This area or space 88 is then suitable for convenient subdividing with other interior walls (not illustrated) to define separate rooms. The walls 90 thereby define cavities 89 for storage spaces between the wall 90 and the stub walls 16, 18. These cavities are used for storage cabinets, as well as raceways for electrical wiring, plumbing for water supply and discharge, and heating and ventilating cooling system equipment, ducts, and the like (not illustrated). The stud-frame walls 90 are conventionally closed by sheet rock, drywall or like materials.

The roof 58 in the illustrated embodiment comprises a decking layer 92 of tongue and groove wood members that are nailed or screwed to the rafter beams 52, 54. This defines an attractive ornamental appearance for an interior ceiling. The exterior surface is then covered with insulated roof panels 93 that are attached with screws to the decking 92. Roofing felt and shingles 94 cover the insulated roof panels 93. In an alternate embodiment (not illustrated), roof panels assembled as a composite are used. Each roof panel includes an insulative layer with exterior roof surfacing. Although not illustrated, dormer windows are readily added to the tapering roof. This enables more head room in an upstairs loft supported by the collar beams 56. For example, a dormer window facilitates a high ceiling in a kitchen portion with a sink base cabinet abutted against the stub wall of the foundation and thereby increasing floor utilization.

Figure 4:
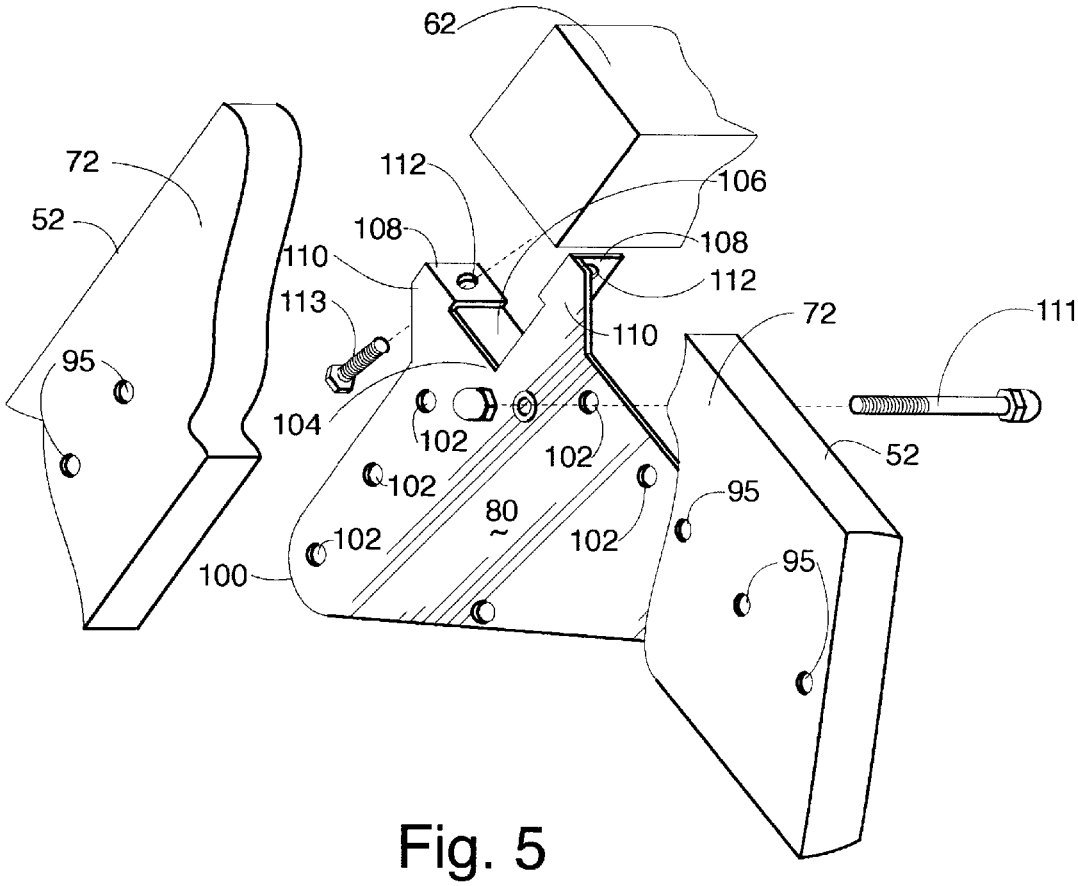
FIG. 4 is a perspective view of a top plate for constructing truss assemblies used in the modified A-frame building illustrated in FIG. 1.

FIG. 4 is a perspective view of the steel top plate 80 for connecting the rafter beams 52, 54 at the apex 64 in the truss 50. The steel top plate 80 is preferably generally triangular in shape with radiused base apexes 100. The top plate 80 defines a plurality of holes 102 spaced apart on opposing side portions on lines extending from the respective base apex 100 to a top apex 104. The top apex 104 defines a notch 106 having opposing sides which define a 90° angle. A ridge flange 108 extends laterally from a leg 110 on opposing sides of the notch 106. The ridge flanges 108 each define a bore 112 for receiving a fastener in order to secure the ridge beam 62 to the apex 104 of the top plate 80. The distal ends 72 of the rafter beams 52 include the pre-drilled holes 95 for receiving bolts through the holes 102 and the rafter beams, which are secured with a washer and nut (one such fastener 111 is illustrated). A fastener 113 passing through the hole 112 secures the ridge beam 62 to the top plate 80.

Figure 5:
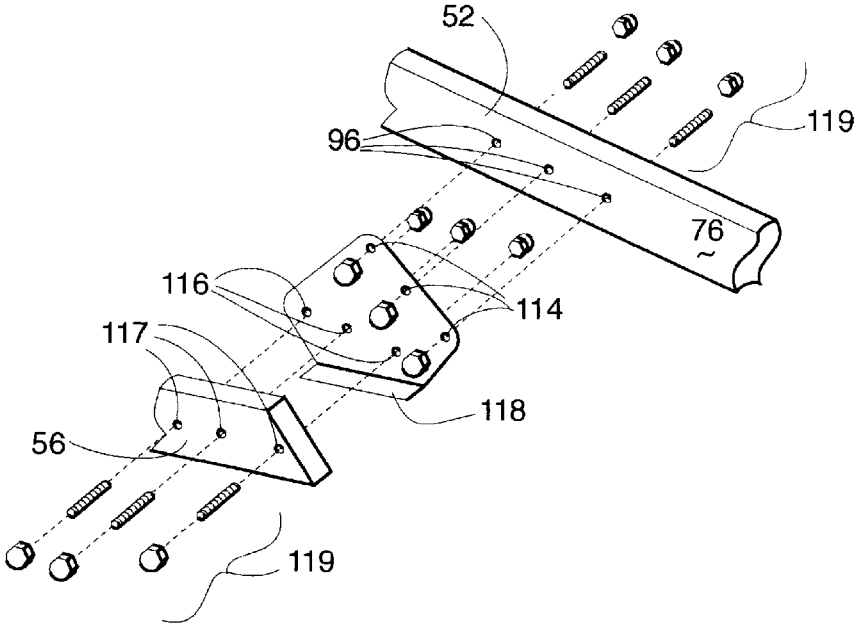
FIG. 5 is a perspective view of a collar beam plate for constructing truss assemblies used in the modified A-frame building illustrated in FIG. 1.

FIG. 5 is a perspective view of the steel mid plate 82 for connecting the collar beam 56 to the rafter beam 52. The mid plate 82 defines holes 114 on a portion that abuts against the side 76 of the rafter beam 52. The holes 114 align with the pre-drilled holes 96 in the rafter beam 52. Holes 116 are defined in the mid plate 82 along a line at an angle to the line of the holes 114 for aligning with a set of pre-drilled holes 117 in the collar beam 56. A collar beam support flange 118 extends laterally from a side face of the plate 82. The collar beam sits on the support flange 118 when the truss 50 is assembled. Threaded members and acorn-style nuts generally 119 are used for securing the collar beam 56, the midplate 82, and the rafter beams 52, 54.

Figure 6:
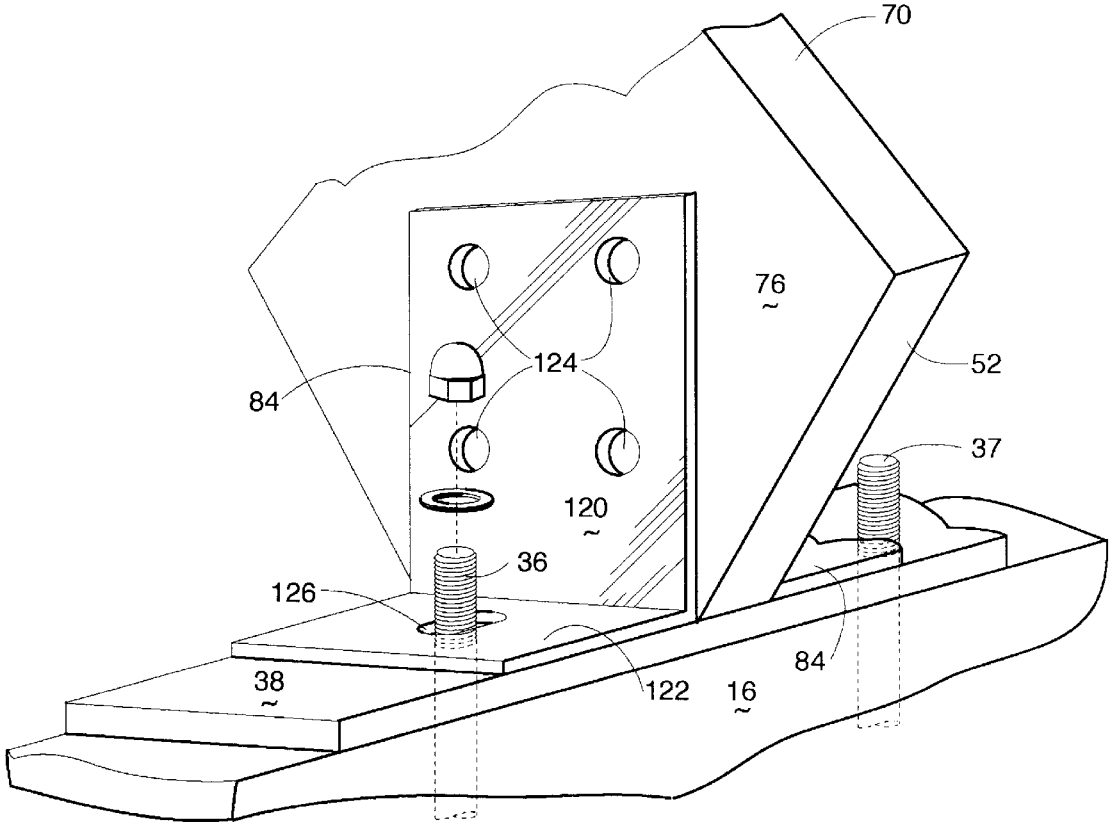
FIG. 6 is a perspective view of a base plate for connecting trusses to the foundation in the modified A-frame building illustrated in FIG. 1.

FIG. 6 is a perspective view of the steel base plate 84 for connecting the distal ends 70 of the rafter beams 52 to the stub walls 16, 18. The base plate 84 is an angle member having a side face 120 and a base 122. The side face 120 defines a plurality of holes 124 for receiving fasteners to connect the base plate 84 to the side face 76 of the rafter beam 52. The holes 124 align with the holes 98 in the rafter beam 52. The base 122 defines a slot 126 for receiving therethrough the end of the threaded pin 36. Appropriate washers and acorn nuts (illustrated, but not numbered) are used to secure the base plate 84 to the rafter beam 52 and to the top plate 38 on the stub walls 16, 18. As discussed above, one of the base plates 84 is attached on the opposing faces 76 of the rafter beam 52. The fasteners (not illustrated) extend through aligned holes in one base plate 84, through the rafter beam 52, and through the opposing base plate 84.

Figure 7:
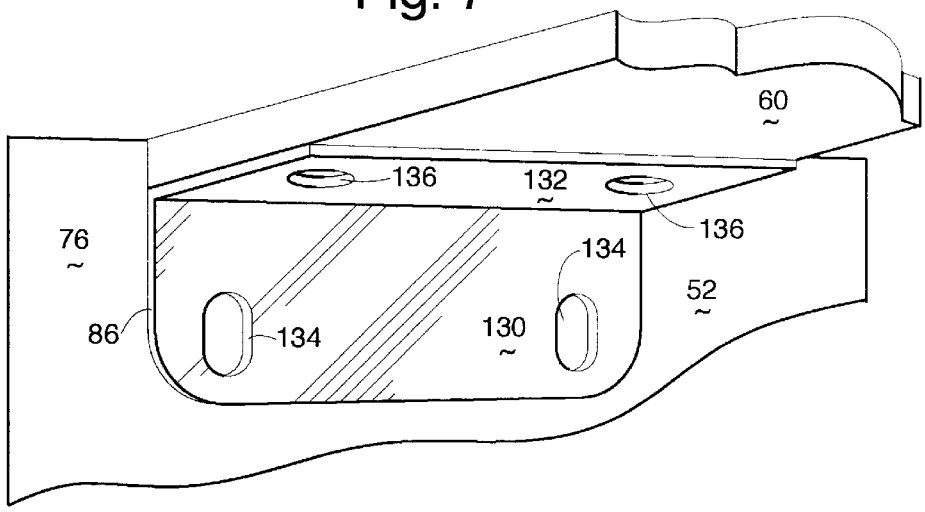
FIG. 7 is a perspective view of a bracket for engaging rack members extending between and connected to adjacent trusses in the modified A-frame building illustrated in FIG. 1.

FIG. 7 is a perspective view of the steel rack bracket 86 having a side face 130 and a laterally extending portion 132. The side 130 defines a pair of spaced-apart slots 134 for receiving fasteners for connecting the rack bracket 86 to the side face 76 of the rafter beam 52. The slots align with the holes 97 in the rafter beam 52. The lateral portion 132 defines a pair of spaced apart holes 136 through which fasteners (not illustrated) extend for connecting the rack bracket 86 to the rack beam 60. Although not illustrated, the rack beams 60 include pre-drilled holes that align with the holes 136.

The modified A-frame building 10 of the present invention is readily constructed from a kit package of the rafter beams 52, the collar beams 56, and the rack beams 60, connected together by the top plates 80, the mid plates 82, the base plates 84, and the rack brackets 86. In a preferred embodiment the building kit provides sufficient material for erecting a 26 foot by 28 foot building. The rafter beams 52 are provided with the sets of drilled holes 95, 96, 97, and 98, which align with the holes in the respective top plate 80, the mid plate 82, the rack brackets 86, and the base plate 84. The three structural beams in the truss 50 are arranged at 45° (the two rafter beams 52 to the collar beam 56) and at 90° (one rafter beam 52 to an opposing rafter beam). This provides advantages and features of the present invention, including 12/12 slope for fit of the rafter beams and the collar beam components and the shape of the roof and building 10 that provides useful interior vertical and horizontal spaces, a central ridge beam 62, and the common interconnecting components that are provided in kit form to a construction site for ready assembly of the modified A-frame building 10 using the improved truss-based structures.

With reference to FIGS. 2, 3, and 4, each truss 50 is assembled by positioning two rafter beams 52 with opposing distal ends 72 abutted together so that the bevel corner 75 are touching. A pair of the top plates 80 are disposed on opposing sides 76 of the rafter beams 52 with the flanges 108 extending outwardly of the sides 76. Bolts extend through the aligned holes 102 in the top plates 80 and the holes 95 in the rafter beams 52, and are secured with nuts. The nuts are preferably tall or "high-rise" acorn-style nuts for ornamental appearance on the interior of the building 10.

With reference to FIGS. 2, 3, and 5, the collar beam 56 is similarly joined to the rafter beams 52 with fasteners and the mid plates 82. Each truss 50 includes four of the mid plates 82 disposed in paired aligned opposing relation for securing the collar beams 56 at distal ends to the rafter beams 52 with bolts and nut fasteners. The fasteners pass through the aligned holes in the mid plate 82 and the collar beam 56 and the rafter beam 52. With reference to FIG. 6, the truss 50 is completed by attaching the base plates 84 with fasteners on opposing sides 76 of the rafter beams 52. A plurality of the trusses 50 are assembled for constructing the illustrated embodiment of the modified A-frame building 10.

With reference to FIG. 1, the foundation 12 is poured conventionally using concrete and steel support structure with the threaded pins 36 embedded in stub walls 16, 18. In the illustrated embodiment, the stub walls 16, 18 extend four feet above the floor 14 of the foundation 12. One of the trusses 50 is elevated, such as with a hoist on a boom truck or scaffolding and positioned with the distal ends 70 on the top plates 38, 40. With reference to FIGS. 1 and 6, the slot 126 in the base plate 84 facilitates alignment of the truss 50 to the walls 16, 18. The pins 36, 37 extend through the slots 126 in the base plate 84. Nuts are used to secure the truss 50 to the pins 36, 37 extending from the stub walls 16, 18. Subsequent ones of the trusses 50 are likewise raised and attached to the stub walls 16, 18. Preferably, the pairs of the threaded pins 36, 37 are disposed on four foot centers to provide a uniform spacing for the trusses 50 along the longitudinal axis of the building 10.

With reference to FIGS. 1 and 7, adjacent trusses 50 are joined together rigidly with the rack beams 60 that connect with fasteners to the rack plates 86. The rack plates 86 connect with bolt and nut fasteners to adjacent faces 76 of the rafter beams 52. The fasteners pass through the holes in the opposed rack plates 86 and the aligned holes 97 in the rafter beam 52. The rack beams 60 strengthen the structure of the roof 58 and set the typical 48 inch spacing between adjacent trusses 50.

With reference to FIGS. 1, 3, and 4, the ridge beam 62 is received in the channel or notch 106, and secured to the top plates 80 with threaded fasteners 113.

Upon erection of the shell building 10, the roof 58 is readily installed as best illustrated in FIGS. 1 and 2. A stop board 59 is secured in position to the distal ends 70 of the rafter beams 52 (ends 72 for the rafter beams 54). A shim block may be needed between the stop board 59 and the decking layer 92 of the roof 58. Preferably the decking boards are 2 inch by 6 inch (nominal) tongue and groove boards. The boards of the layer 92 are secured with fasteners such as nails or screws to the upper faces 78 of the rafter beams 52. The layer 92 is then covered by insulated panels 93 and the exterior surface covered with tar paper or roofing felt, and shingles 94 or other roofing material are installed for weather-proofing the shell building 10. The insulated panels 93 are preferably a composite panel having an OSB exterior material bonded to a 5½ inch EPS foam insulation panel. The roof felt and roof shingles 94 are nailed to the OBS shelving of the insulated panels 93.

Figure 8:
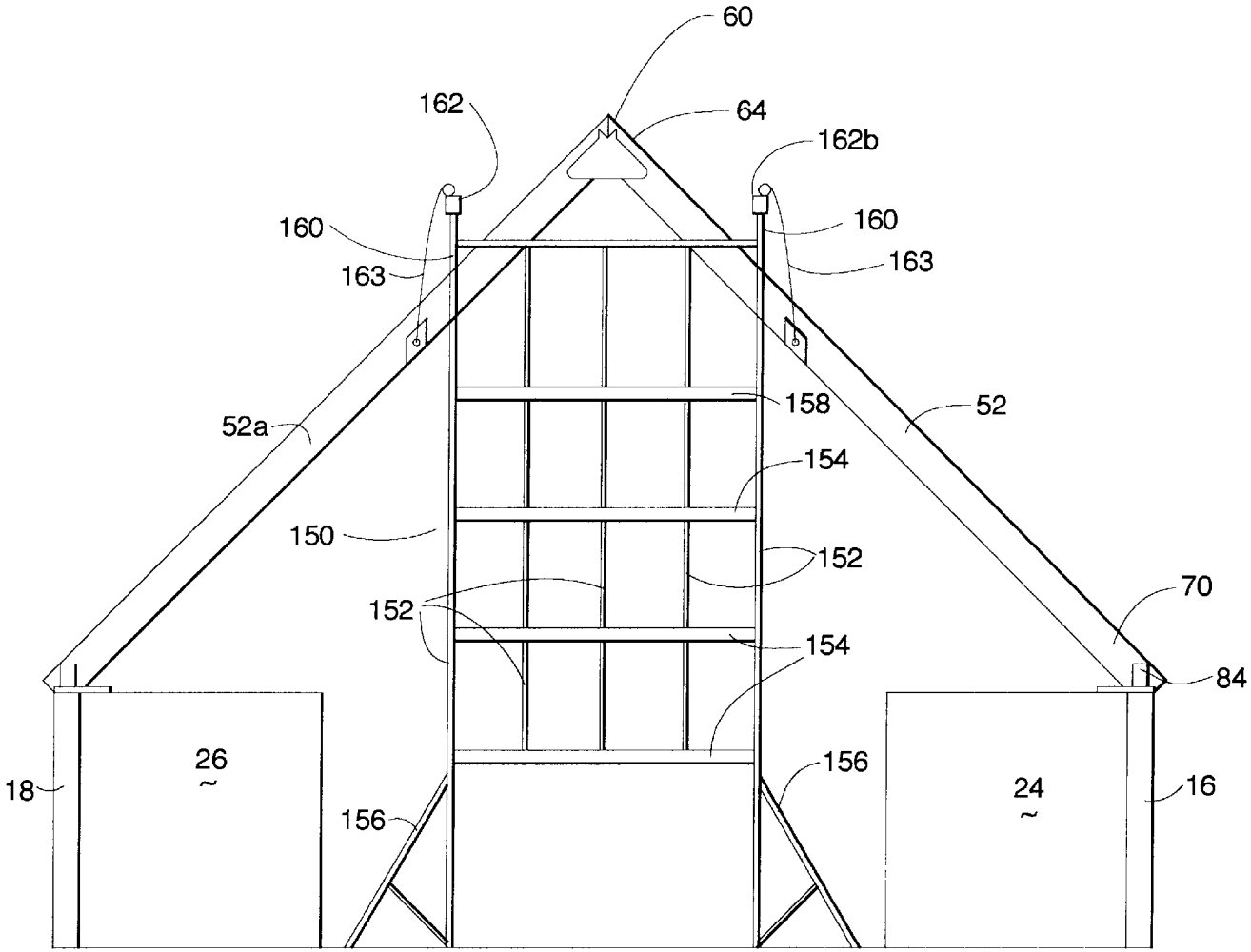
FIG. 8 is a front side elevation view of a scaffolding for assembly of the modified A-frame building illustrated in FIG. 1.

FIG. 8 is a front side elevational view showing a scaffolding 150 for use in erecting the modified A-frame building 10 illustrated in FIG. 1. The scaffolding 150 provides a alternate method of truss assembly and building construction. The scaffolding 150 has vertical members 152, transverse members 154 and side supports 156. An upper portion of the scaffolding 150 supports a decking 158 on which the builders stand for assembling the truss 50. Opposing hoist supports 160 mount to two of the vertical members 152 at opposing ends of the decking 158. A winch 162 mounts to the distal ends of the hoist supports 158. The winch 162 includes a cable 163. The winch 162 is preferably a manually operated handle winch with a safety lock, capable of lifting the glue laminated rafter beams 52.

The rafter beams 52 and the collar beams 56 are delivered to the construction site unassembled. The trusses 50 are assembled one beam at a time, utilizing the scaffold system 150. The hand winches 162 at the top of the scaffolding 150 are used to raise each of the left and right rafter beams 52. In one embodiment, the top of the scaffold is approximately 14 feet high.

Assembly of the trusses 50 is accomplished by placing one of the rafter beams 52 horizontally between a support on the scaffold 150 with the base end 70 on the foundation stub wall 16 between the attached base brackets 84. A temporary bolt and matching nut inserts into one of the top holes 124 of the bracket 84 through the top hole drilled in the base 70 of the beam 52 (see FIG. 6). A winch bracket 165 attaches around the beam 52 at one of the holes 97 on the beam 52 for the rack beam bracket, approximately two-thirds the length of the rafter beam from the distal end 70. The cable 163 of the winch **162*b* connects to the winch bracket 165**.

The hand winch **162*b* is operated to move the beam 52 upwardly (with a weight of about 70 pounds) due to the hinging of the beam 52 to the base bracket 89. The front surface of the scaffold 150 has tube bumpers such as PVC tubes, adjacent to the beams, to prevent damage to the beams as they are raised. The rafter beam 52 is winched up at an angle to slightly above its finished position. This allows the second opposing rafter 54 to clear the rafter 52 during assembly. A temporary stub is positioned under the beam 52** for support.

An opposing rafter beam **52*a* is then similarly pinned to its respective base brackets 84 and connected to the cable 163 of the winch 162*a*. The rafter 52*a* is then raised into position with the second winch 162*a*. The winches 162 are adjusted until the top bevel edges 75 of the opposing beams 52 are almost touching (see FIGS. 3 and 4). A bolt is inserted into the bottom holes of the rafter beams 52 and the steel top plates 80 to secure the rafter beams and the top plates together. The winches 162 are lowered until the top bevel edges 75 form the 90° angle that also defines the notch 106 for the ridge beam 62. The bolts and nuts are then assembled and tightened to secure the top truss plates 80 to the respective rafters 52, 54**.

The collar beam 56 is attached with appropriate bolts and acorn nuts, as illustrated in FIGS. 3 and 5. This is accomplished by attaching the mid truss plates 82 to the collar beams 56 and the respective rafters 52, 54. The rack beams 60 are attached to the rack beam brackets 86 on the rafters 52 with bolts and acorn nuts (see FIG. 7).

In a preferred embodiment, the scaffold 150 has retractable wheels. This enables it to be rolled to the location of the adjacent truss 50. The process of erecting rafter beams 52 and collar beams 56 continues, until the end truss is reached. The scaffolding 150 is rotated 1800 for installation of the final truss. Thereafter, the ridge beam 62 is installed and the roof 58 is installed as discussed above. The ends of the building 10 are closed with conventional stud frame walls and exterior finishings as illustrated in FIG. 1. The interior of the building 10 is conventionally completed.

Thus, there is been described a readily assembled and constructed modified A-frame building and truss for constructing such a building at a reasonable cost, in combination with architectural quality glue-laminated beams, steel plates for beam connections which preferably are laser cut and powder painted, with attractive chromed acorn nuts and stainless steel washers for connecting hardware, with the result of a ornamentally attractive structure ready for interior completion. The principles, preferred embodiments, and modes of operation of the present invention have been described in the forgoing specifications. The invention is not to be construed as limited to the particular forms disclosed because these are regarded as illustrative rather than restrictive. Moreover, variations and changes maybe made by those skilled in the art without departing from the spirit of the invention as described by the following claims.

What is claimed is:

1. A modified A-frame shell building, comprising:

a cementitious foundation defining a base and a pair of upstanding opposing stub walls that extend from the base to a predetermined height;

a plurality of trusses defining supports for a roof disposed in spaced-apart relation and attached to opposing stub walls, each truss comprising:

a pair of elongated rafter beams having side faces and bottom faces, each having a first and a second 45° beveled corner at opposing first and second distal ends, and the pair of rafter beams rigidly joined together at a 90° angle at the respective first distal ends with the first beveled corners of the pair of rafter beams abutted together;

the aligned first distal ends of the pair of rafter beams defining a trough;

an elongated collar beam oppositely beveled at opposing distal ends and abutted against bottom faces of the pair of rafter beams intermediate the distal ends thereof;

a pair of collar beam connector plates with a plurality of fasteners to rigidly connect the collar beam to the pair of rafter beams at the opposing distal ends; and a pair of angled end connector plates having intersecting surfaces and fastened on one surface to the side faces of the pair of rafter beams at the opposing second beveled corner and for being fastened on the other surface to an upper edge of a foundation wall;

an elongated roof ridge member extending between the spaced-apart trusses and received in the troughs; and a plurality of roofing members attached to the upper surfaces of the rafter beams.

2. The modified A-frame building as recited in claim 1, wherein the roofing members comprise:

a decking of a plurality of tongue and groove boards;

an insulative layer; and a sheaving layer of shingles.

3. The modified A-frame building as recited in claim 1, wherein the stub walls are approximately one-half the height of a conventional framed house.

4. The modified A-building has recited in claim 3, wherein the stub walls are approximately 4 feet high.

5. The modified A-frame shell building as recited in claim 1, further comprising an elongate member attached to a distal end of the stub walls, the second distal end of the rafter beams seating on and attached to the elongate member.

6. A truss for use with a plurality of such trusses to construct an A-frame building, comprising:

a pair of elongated glue laminated rafter beams having side faces and bottom faces, each having a first and a second 45° beveled corner at opposing first and second distal ends, and the pair of rafter beams rigidly joined together at a 90° angle at the respective first distal ends with the first beveled corners of the pair of rafter beams abutted together, thereby defining a 12/12 slope for the angled beams;

the aligned first distal ends of the pair of rafter beams defining a 90° trough for receiving an elongated roof ridge member to extend at least between adjacent ones of the trusses;

a pair of opposing top plates that overlap side faces of the pair of rafter beams with fasteners for rigidly connecting the rafter beams together;

an elongated collar beam oppositely beveled at opposing distal ends and abutted against bottom faces of the pair of rafter beams intermediate the distal ends thereof;

a pair of collar beam connector plates with a plurality of fasteners to rigidly connect the collar beam to the pair of rafter beams at the opposing distal ends; and a pair of angled end connector plates having intersecting surfaces and fastened on one surface to the side faces of the pair of rafter beams at the opposing second beveled corner and for being fastened on the other surface to a top plate on an upper edge of a foundation wall.

7. The truss as recited in claim 6, further comprising a pair of angled rack brackets rigidly connected to opposing side faces of each one of the pair of rafter beams intermediate the opposing distal ends thereof for engaging therewith an elongate intermediate roofing rack member extending between adjacent ones of the truss.

8. A truss for use with a plurality of such trusses to construct an A-frame building, comprising:

a pair of elongated rafter beams having side faces and bottom faces, each having a first and a second 45° beveled corner at opposing first and second distal ends, and the a pair of rafter beams rigidly joined together at a 90° angle at the respective first distal ends with the first beveled corners of the pair of rafter beams abutted together;

the aligned first distal ends of the pair of rafter beams defining a 90° trough for receiving an elongated roof ridge member to extend at least between adjacent ones of the trusses;

an elongated collar beam oppositely beveled at opposing distal ends and abutted against bottom faces of the pair of rafter beams intermediate the distal ends thereof;

a pair of collar beam connector plates with a plurality of fasteners to rigidly connect the collar beam to the pair of rafter beams at the opposing distal ends; and a pair of angled end connector plates having intersecting surfaces and fastened on one surface to the side faces of the pair of rafter beams at the opposing second beveled corner and for being fastened on the other surface to a top plate on an upper edge of a foundation wall.

9. The truss as recited in claim 8, wherein the rafters are glue laminated beams.

10. The truss as recited in claim 8, further comprising a pair of opposing top plates that overlap side faces of the pair of rafter beams with fasteners for rigidly connecting the rafter beams together.

11. The truss as recited in claim 8, further comprising a pair of angled rack brackets rigidly connected to opposing side faces of each one of the pair of rafter beams intermediate the opposing distal ends thereof for engaging therewith an elongate intermediate roofing rack member extending between adjacent ones of the truss.

* * * * *